United States Patent [19]

Simpson

[11] 4,117,552

[45] Oct. 3, 1978

[54] PROTECTIVE CLOTHING

[75] Inventor: Robert Emmerson Simpson, Fleet, England

[73] Assignee: The Secretary of State for Defence in Her Britannic Majesty's Government of the United Kingdom of Great Britain and Northern Ireland, London, England

[21] Appl. No.: 796,707

[22] Filed: May 13, 1977

[30] Foreign Application Priority Data

May 14, 1976 [GB] United Kingdom ..... 20136/76

[51] Int. Cl.[2] ..... A62B 17/00

[52] U.S. Cl. ..... 2/2.1 A; 2/79; 2/82; 2/269

[58] Field of Search ..... 2/79, 81, 82, 227, 232, 2/232 A, 269, 2.1 A, 2.1, 2

[56] References Cited

U.S. PATENT DOCUMENTS

| | | | |
|---|---|---|---|
| 1,082,213 | 12/1913 | Robinson | 2/81 |
| 2,131,055 | 9/1938 | Ladue | 2/269 X |
| 2,521,767 | 9/1950 | Zecha | 2/79 |
| 2,669,726 | 2/1954 | Meisel | 2/269 X |
| 2,716,754 | 9/1955 | Hirsch | 2/79 X |
| 2,994,089 | 8/1961 | Ferguson | 2/81 |
| 3,209,370 | 10/1965 | Miller | 2/232 |

FOREIGN PATENT DOCUMENTS

| | | | |
|---|---|---|---|
| 1,410,770 | 8/1965 | France | 2/227 |
| 1,115,414 | 5/1968 | United Kingdom | 2/81 |
| 1,173,143 | 12/1969 | United Kingdom | 2/81 |

*Primary Examiner*—H. Hampton Hunter

*Attorney, Agent, or Firm*—Cushman, Darby & Cushman

[57] ABSTRACT

An inter-inner-and-outer-clothing overall garment comprising a layer of air permeable cloth treated with oleophobic compound to render a designated outer surface thereof liquid repellant and having activated charcoal approximate a designated inner surface thereof, the garment being the product of a manufacturing process in which only a small number of sizes of said garment are made, the garment having limb members long enough to cover the limbs of the longest limbed subject for that size of garment.

5 Claims, 2 Drawing Figures

PROTECTIVE CLOTHING

Figure 1:
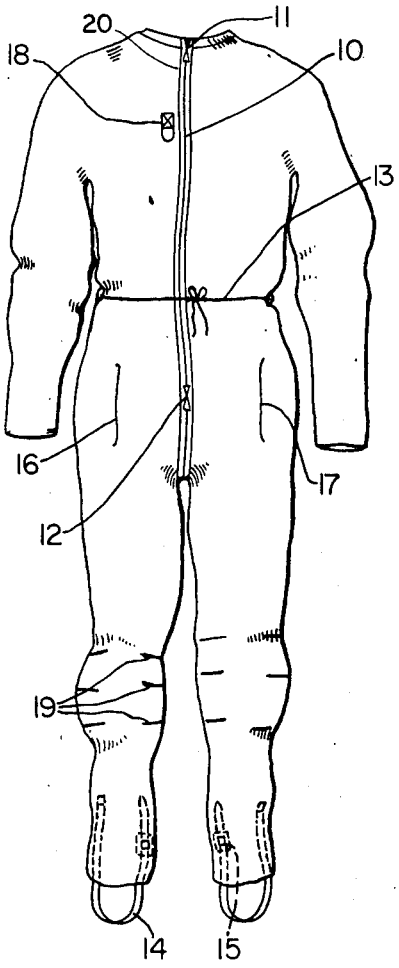

The present invention relates to protective clothing for protecting a person against unpleasant or toxic substances. It is particularly concerned with garments for protecting a person against undesirable or toxic chemical substances when they are or have been atmospherically borne.

The preferred fabric for such clothing comprises a layer of air-permeable cloth treated with an oleophobic compound to render its outer surface liquid repellant and with activated carbon on the inner surface, whereby the fabric allows outward passage of gases and perspiration but prevents the inward passages of the undersirable substances. Such fabrics are described in U.S. Pat. Nos. 3,502,537 and 3,586,596, and UK Patent Specification No. 1,222,502.

It was soon realized that a concentration of the undersirable substance on the a parts of the fabric, for example at the fold of a limb, could be forced therethrough. To prevent this the fabric was provided with an outer layer of wick-like material adapted to spread a concentration of the undesirable substance thereover and prevent it from being forced under mechanical pressure through the fabric. This is the subject of UK Patent Specification No. 1,206,581.

The present invention provides an improvement in the protective clothing described in UK Patent Specification No. 1,206,581.

It has been discovered that considerable saving in garment bulk weight and cost of protective fabric and thereby also an improvement in user comfort and mobility, can be made according to the present invention by making up the fabric of U.S. Pat. No. 3,586,596 into an inter-inner-and-outer-clothing garment, that is to say, a garment liner suitable for wearing over such undergarments as undershirts, shirts, vests, underpants, long johns and socks and under such outer garments as trousers, jackets, pullovers, overalls and shoes. Thus the normal outer clothing, for example jacket and trousers or overalls, performs the role of the wicking. This also allows pockets etc. to be available on the outer clothing as usual and not to have to be provided on the protective clothing.

According to the present invention therefore there is provided an inter-inter-and-outer-clothing overall garment for covering the torso and limbs of a wearer, the garment comprising a layer of air permeable cloth treated with an oleophobic compound to render a designated outer surface thereof liquid repellant and having activated carbon approximate a designated inner surface thereof. It not being consistent with the required standard of garment fit to provide for all possible torso lengths and circumferences in one garment size, particularly for aircrew, it has been determined that nine different sizes of the undercoverall will be adequate and afford protection of military personnel, provided that as produced its limb members are long enough to accommodate the longest limbed subjects in each size and they can be trimmed or folded back as required.

According to an important feature of the invention therefore the garment may be one of a small number of garment sizes and have limb members long enough to cover the limbs of the longest limbed subject suited to wear a garment of that particular size. Garment leg members may have retaining means for maintaining cover of each whole leg of the wearer by the corresponding garment leg member, and leg length adjustment means permitting shortening of the leg members so that they can cover the legs of the shortest legged subject for that size garment without impairing the operation of the leg retaining means. Of course, different limb lengths could be provided using foot and hand garments with a variety of lengths of associated hosiery and attachment means such as touch and close fasteners or sliding fasteners for attaching them to the garment limbs. This, however, scarcely enables achievement of a very desirable objective, the reduction in the number of sizes of garment which have to be made, stored, and related to the designated wearer.

Whilst the garment arm members may be tucked inside gloves, even if folded back, to maintain unbroken coverage of the wearer's arms, this is not a satisfactory solution for legs, since droplets of unabsorbed undesirable fluid may collect at the upper junction so formed and then be able to run downwards to the interior of the protective foot garment. Nor, of course, is this solution satisfactory for personnel whose arms are likely held or dangled downwards for long periods during exposure to the undesirable environment.

The leg member cover retaining means may therefore comprise foot portions thereto and the leg length adjustment means touch and close fastener means. Preferably however the retaining and adjustment means comprises elasticated adjustable instep stirrups one anchored to each leg member at a station, advantageously inside the leg member, above that required satisfactorily to cover the legs of the shortest legged subject built to wear the particular size of suit. As it is preferred that the stirrups be worn inside any shoes or boots, then if long boots are to be worn, as is sometimes the case with aircrew, the anchorage of the stirrups is preferably also arranged to be above the highest likely reach of the boot upper.

With regard to the arm members of the garment it is normally satisfactory to provide that gloves will cover, surround and grip upon the cuffs thereof. Thumb loops may be provided if desired inside the cuffs of the garment. If not for permanent use they may serve to retain the cuffs in position when donning or wearing outer sleeved garments.

An undercoverall in accordance with the present invention may be donned and fastened using a sliding fastener system extending from a neck region thereof down the front centre of the torso at least to a crutch region thereof and perhaps via the crutch to the waist at the back. With two or three sliding members to the fastener the garment can be readily donned and doffed and opened selectively for urination or perhaps also defaecation. Although a gas tight fastener may be used it has been found acceptable to use an ordinary non gas-tight fastener backed by a strip of the protective fabric.

According to another feature of the invention the limb members of the garment are made baggy at outer elbow and knee regions thereof to relieve mechanical stress on those regions when these joints are flexed. The excess fabric may be obtained by providing the limb members with tucks or darts at appropriate side seam locations.

The garment may be provided with an access tunnel or tunnels for the servicing tubes of a fluid conditioning undergarment, such as the liquid conditioned undergarment described in U.S. Pat. Nos. 3,316,732, 3,392,545, and 3,425,486, or for the servicing hose of an anti-g garment or electrically heated suit supply leads etc.

The clothing assembly including an undercoverall in accordance with the invention will for aircrew therefore comprise typically, in the order of donning, underwear including undershirt and drawers, which are preferably long-limbed, or a fluid conditioned undergarment, socks, the undercoverall, an anti-g garment then outer clothing such as trousers, jacket, and/or overall and life preserver or torso harness. The use of long sleeved undershirt and long drawers prevents contact between the skin of the wearer and the activated carbon. Additional insulative clothing, such as pullovers and bunny suits are preferably worn beneath the undercoverall. Of course protective gloves and socks in accordance with the invention may be worn, covered by shoes or boots and possibly outer gloves. Alternatively since the requirement for air permeability may be less at the limb extremities than for the body as a whole impermeable inner or outer protective clothing may there be worn.

Application of the philosophy of the present invention to the region of the head requires consideration of the problems of respiration, comfort, visibility, communication, and sizing, but such a respirator is described in co-pending U.S. Ser. No. 795,642, filed May 10, 1977.

Figure 2:
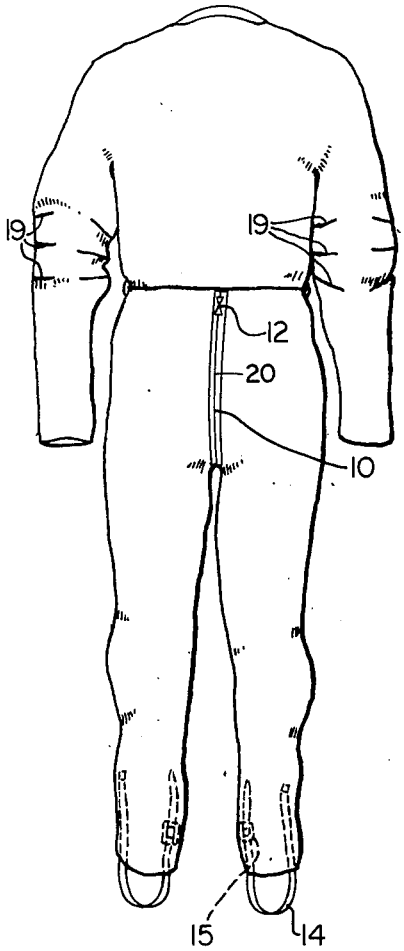

A garment in accordance with the invention will now be described, by way of example, with respect to the accompanying drawings, of which:

FIGS. 1 and 2 are front and back views thereof respectively.

The garment shown in the drawings is a one-piece inter-inner-and-outer-clothing garment or undercoverall donned and doffed by means of a sliding fastener system 10 extending from a neck region thereof down the front of the garment under a crutch thereof and up to a waist region thereof at the rear. Three sliders are provided on the fastener system, a donning slider 11 operable from the neck to the lower abdomen and two urination and defaecation access sliders 12 operable from the lower abdomen to the waist front and waist rear respectively. The garment has a waist tie cord 13, elastic foot stirrups 14, adjustable by buckles 15, liquid conditioned suits service tube access tunnels 16, 17, and a 'D' ring 18, attached to the chest of the undercoverall as a temporary attachment for respiration tubing during donning and doffing.

The material of the undercoverall is a non-woven fabric of the type described in U.S. Pat. No. 3,586,596 and comprises nylon fibres with a small proportion of viscose rayon. The fabric is treated with a fluorocarbon to impart a degree of repellancy to organic chemicals and the fibre inner surface is coated with activated charcoal. The fabric is air permeable. In order to avoid damage or diminishment of viability due to mechanical pressure and to aid mobility the undercoverall is provided with excess fabric over the outside knee and elbow joints by means of tucks 19, in the front leg and hind sleeve panels which are far enough apart to ensure that the excess fabric coincides with the joint region for all joint positions in the particular size. Also the fastener is backed by a strip 20 of the fabric.

The undercoverall is manufactured in nine sizes, with the limbs thereof the longest for any subject in the particular size and the stirrups 14 anchored to the interior of the legs above the length thereof for the shortest legged subject in the particular size and to accommodate the boot 'uppers' inside the garment leg ends.

Upon acquisition, therefore, of a new undercoverall in his size range and first donning, the user, after adjustment of the stirrups 14, by the buckles 15, will if necessary cut or fold the leg and arm cuffs back until the limbs of the undercoverall are the right length for his legs and arms when these limb joints are fully flexed.

In use of the undercoverall by a military aircrewman, the latter dons first of all conventional socks and long-limbed underwear or a liquid conditioned suit (LCS) of the type described in U.S. Pat. No. 3,425,486, which is a long-sleeved, long legged one-piece garment. He then dons protective inner socks followed by the protective undercoverall using the sliding fastener system 10, where applicable feeding the LCS service tubes through the access tunnel 16, 17 appropriate for the conditioning liquid supply. If he is to use the under-helmet respirator described in co-pending U.S. patent application Ser. No. 975,642, filed May 10, 1977 this is donned at this stage and the supply hoses therefore temporarily attached to the undercoverall at 18. Cotton inner gloves are then put on followed by impermeable protective gloves. The outer protective helmet is now donned followed by his anti-g garment and the flying overall and the support for the respirator supply hoses moved thereto, and finally the aircrew boots, together with protective overboots for temporary use on the ground, the life-preserver or torso harness, seat and/or parachute harness as appropriate and the respirator supply hoses manifold transferred to the life-preserver or Torso Harness.

In an alternative construction the undercoverall fastener 10, extends from the collar to the crutch only and has in addition to slider 11 only one slider 12 at the crutch position. The slider 12 is arranged to open the fastener upwards for urination purposes, that is, in the opposite sense to the slider 11.

For military personnel, especially aircrewmen, the limb length variation with any particular size of garment has been determined in an anthropometric survey.

I claim:

1. A garment liner for wearing between inner and outer garments having a torso member with a neck region thereto, two leg members and two arm members and wearable by a human subject to cover at least his torso, arms and legs, said garment liner being formed of a fabric comprising a layer of air-permeable cloth treated with an oleophobic compound to render the designated outer surface thereof liquid repellent and having activated carbon approximate the designated inner surface thereof, said arm and leg members being long enough satisfactorily to envelop the arms and legs respectively of the longest limbed subject for whom said garment is otherwise suitable, said garment also having elasticated adjustable stirrups operative in use to maintain envelopment of each whole leg by said leg members, one stirrup anchored within each leg member at a station above that required for the stirrups satisfactorily to maintain leg member envelopment of the legs of the shortest legged subject for whom said garment is otherwise suitable, whereby excess garment leg fabric can be cut away or turned up, a donning, doffing and access fastener means extending from said neck region down the designated front of said garment at least to a crotch region between said leg members, said fastener means being both selectively openable to permit access to said crotch region for the purpose of urination and completely openable for donning/doffing purposes, and said arm and leg members being provided with excess fabric in outer elbow and knee regions thereof.

2. A garment as claimed in claim 1, and wherein the fastener means is a slide fastener having at least two sliders, one for opening said fastener from the neck region downwards and the other for opening said fastener from the crotch upwards.

3. A garment as claimed in claim 1, and wherein the fastener means is backed by a strip of said fabric.

4. A garment as claimed in claim 1, and wherein the torso member has at least one servicing tube access tunnel for servicing tubes of a conditioning undergarment.

5. A garment liner for wearing between inner and outer garments having a torso member with a neck region thereto, two leg members and two arm members and wearable by a human subject to cover at least his arms, legs and torso, said garment liner being formed of a fabric comprising a layer of air-permeable cloth treated with an oleophobic compound to render the designated outer surface thereof liquid repellent and having activated carbon approximate the designated inner surface thereof, said arm and leg members being long enough satisfactorily to cover the arms and legs respectively of the longest limbed subject for whom said garment is otherwise suitable, said garment also having elasticated adjustable stirrups operative in use to maintain envelopment of the whole leg by said leg member, one stirrup anchored within each leg member at a station above that required for the stirrups satisfactorily to maintain leg member cover of the legs of the shortest legged subject for whom said garment is otherwise suitable, whereby excess garment leg fabric can be cut away or turned up, a slide fastener extending from said neck region down the designated front of said garment at least to a crotch region thereof between said two leg members and at least two sliders to said fastener, one slider openable to open said fastener from said neck region downwards and the other said slider openable to open said fastener from said crotch region upwards, said slide fastener being backed by a strip of said fabric, said torso member having at least one servicing tube access tunnel for servicing tubes of a conditioning undergarment, and said arm and leg members being provided with excess fabric in outer elbow and knee regions thereof.

* * * * *